US006947016B2

(12) United States Patent
Kim et al.

(10) Patent No.: US 6,947,016 B2
(45) Date of Patent: Sep. 20, 2005

(54) METHOD AND APPARATUS FOR DRIVING PLASMA DISPLAY PANEL OPERATING WITH MIDDLE DISCHARGE MODE IN RESET PERIOD

(75) Inventors: Jin-Sung Kim, Anyang (KR); Jin-Boo Son, Busan (KR); Jea-Hyuk Lim, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 242 days.

(21) Appl. No.: 10/217,808

(22) Filed: Aug. 13, 2002

(65) Prior Publication Data

US 2003/0090441 A1 May 15, 2003

Related U.S. Application Data

(60) Provisional application No. 60/331,296, filed on Nov. 14, 2001.

(51) Int. Cl.[7] ..... G09G 3/28
(52) U.S. Cl. ..... 345/60; 345/37; 345/41
(58) Field of Search ..... 345/60, 66, 72, 345/89, 63, 41, 37; 315/169.4

(56) References Cited

U.S. PATENT DOCUMENTS 5,877,734 A * 3/1999 Amemiya ..... 345/60
6,097,357 A * 8/2000 Shinoda et al. ..... 345/63
6,489,727 B2 * 12/2002 Kanazawa ..... 315/169.4
6,653,994 B2 * 11/2003 Takeda et al. ..... 345/60
6,707,436 B2 * 3/2004 Setoguchi et al. ..... 345/60

* cited by examiner

*Primary Examiner*—Albert Decady
*Assistant Examiner*—Fritz Alphonae
(74) *Attorney, Agent, or Firm*—McGuireWoods LLP

(57) ABSTRACT

A method for driving a plasma display panel includes applying an erasing pulse, a reset pulse and a scan pulse respectively in each of an erasing period, a reset period and a scan period. In a reset period, a reset pulse with a waveform of a sloped ramp pulse is applied to the scan electrode. The sloped ramp pulse induces a discharge between the scan electrode and the address electrode in the middle of the period while the pulse voltage increases. This prevents extremely high discharges between the scan electrode and the address electrode and improves the contrast of the display. An apparatus that implements such method is also disclosed.

28 Claims, 19 Drawing Sheets

FIG. 3B

| BACKGROUND BRIGHTNESS | RISING SLOPE |
|---|---|
| 0.41 | 657 |
| 0.4 | 134 |
| 0.39 | 118 |
| 0.38 | 106 |
| 0.37 | 91 |
| 0.36 | 77 |
| 0.35 | 73 |
| 0.34 | 65 |
| 0.33 | 61 |
| 0.32 | 53 |
| 0.31 | 47 |
| 0.3 | 42.9 |
| 0.29 | 37.2 |
| 0.25 | 14 |
| 0.22 | 12.7 |

METHOD AND APPARATUS FOR DRIVING PLASMA DISPLAY PANEL OPERATING WITH MIDDLE DISCHARGE MODE IN RESET PERIOD

CROSS REFERENCE TO RELATED APPLICATION

This application is based on U.S. Provisional Application No. 60/331,296 filed on Nov. 14, 2001, of which content is hereby incorporated by reference and the benefit of which filing date is hereby claimed.

BACKGROUND OF THE INVENTION

1. Field of the Invention

The present invention relates to a method and apparatus for driving a plasma display panel used for displaying images in a television set or a computer monitor, and more particularly, to a method and apparatus for driving a plasma display panel, which can improve the image contrast by suppressing excessive discharges during a reset period.

2. Description of the Related Art

Contrast is an important factor affecting the quality of an image produced by a plasma display panel (PDP). Contrast is represented by the ratio of the brightness of a bright portion to the brightness of a dark portion in a picture displayed on a panel. The bright portion mainly comes from light generated by a sustain discharge, and the dark portion comes from light generated by a reset discharge. It is necessary to increase the brightness of the bright portion or decrease the brightness of the dark portion in order to enhance the contrast. The driving period of a PDP is divided into a reset period, an address period, and a sustain period. The reset period most greatly influences the brightness of the background image of a panel. Conventionally, with a sustain electrode at a ground voltage, a voltage which slowly increases is applied to a scan electrode to form negative wall charges on the scan electrode. Positive wall charges on an address electrode are formed due to a consecutive weak discharge between the scan electrode and the sustain electrode. Thereafter, the voltage applied to the scan electrode is slowly decreased, thereby decreasing the wall charges which have excessively been formed on the electrodes. However, according to a conventional method, a discharge occurring between the scan electrode and the sustain electrode during the reset period increases the background brightness, thereby decreasing the contrast.

SUMMARY OF THE INVENTION

To solve the above-described problems, it is an object of the present invention to provide a method and apparatus for driving a plasma display panel, through which a dark portion can be displayed to be darker to enhance contrast by performing a middle discharge in reset period during a panel display driving operation.

BRIEF DESCRIPTION OF THE DRAWINGS

The above objects and advantages of the present invention will become more apparent by describing in detail preferred embodiments thereof with reference to the attached drawings.

FIGS. 3A and 3B are a graph and a table, respectively, which show the relationship between the rising slope of a first ramp pulse during a reset period and the intensity of the background brightness;

DETAILED DESCRIPTION OF THE INVENTION

Hereinafter, embodiments of the present invention will be described in detail with reference to the attached drawings.

During a reset period, wall charges are formed on electrodes so that an address operation can be smoothly accomplished. The present invention provides a method for improving contrast by suppressing discharges between a scan electrode and a sustain electrode during a reset period. It is preferable that a ramp having an increasing slope is applied to the scan electrode during the reset period. In using a ramp pulse, in order to prevent a discharge between a scan electrode and a sustain electrode during a reset period, a constant bias voltage is applied to the sustain electrode and a ramp pulse is applied to the scan electrode, thereby provoking a discharge between an address electrode and the scan electrode. Here, the reset discharge provoked between the address electrode and the scan electrode is different from a consecutive weak discharge provoked due to a conventional rising ramp voltage and is also different from a strong discharge provoked in all of the cells with the same voltage when a square reset pulse is applied. Hereinafter, such a discharge provoked during a reset period according to the present invention is referred to as a "medium discharge". In other words, during a reset period, a voltage is applied to electrodes using a reset pulse which allows the potential difference between an address electrode and a scan electrode to increase with a predetermined slope, so a discharge occurs between the address electrode and the scan electrode in the middle of the increase in the potential difference. The intensity of this discharge is less than the intensity of a strong discharge. In addition, while the reset pulse is being applied, at least two discharges can occur between the electrodes. At least two discharges do not consecutively occur like a weak discharge but occur discontinuously in terms of time and intensity. A middle discharge mode will be described in detail by explaining embodiments of the present invention.

According to the present invention, a reset discharge occurs according to a discharge start voltage between an address electrode and a scan electrode in each cell, thereby preventing wall charges from being excessively formed and also decreasing background brightness compared to a conventional method.

Figure 1A:
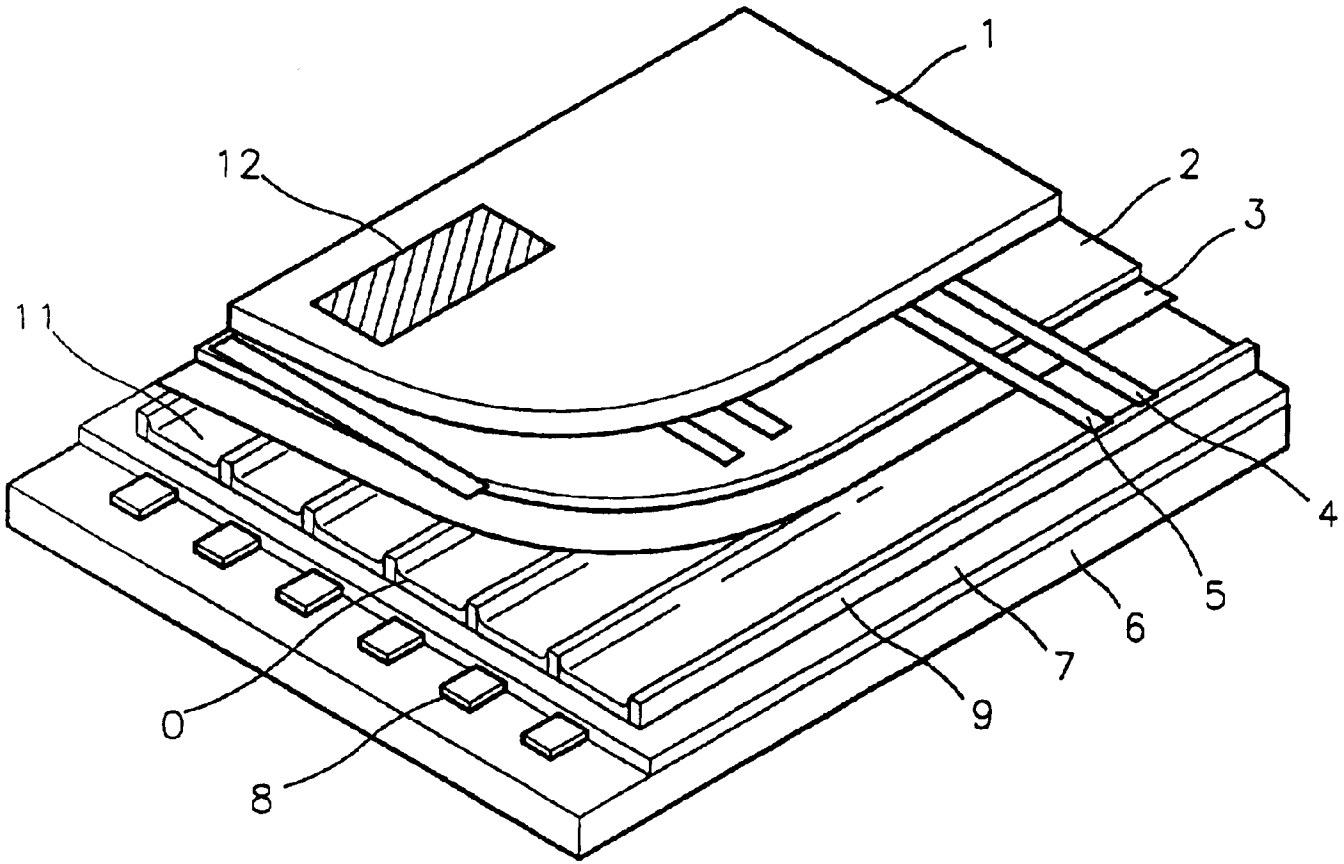
FIG. 1A is a perspective view of a part of an AC plasma display panel.

FIG. 1A is a perspective view of a part of an AC plasma display panel. Pairs of a scan electrode 4 and a sustain electrode 5 which are covered with a dielectric layer 2 and a protective layer 3, are formed to be parallel to one another on a first glass substrate 1. A plurality of address electrodes 8 covered with an insulator layer 7 are formed on a second glass substrate 6. Partition walls 9 are formed on the insulator layer 7 to be parallel to the address electrodes 8. A phosphor layer 10 is formed on the surface of the insulator layer 7 and both sides of the partition walls 9. The first glass substrate 1 and the second glass substrate 6 are disposed to face each other with a discharge space 11 therebetween so that the scan electrodes 4 and the sustain electrodes 5 are orthogonal to the address electrodes 8. The discharge space 11 at an intersection between each address electrode 8 and each pair of a scan electrode 4 and a sustain electrode 5 forms a discharge cell 12.

Figure 1B:
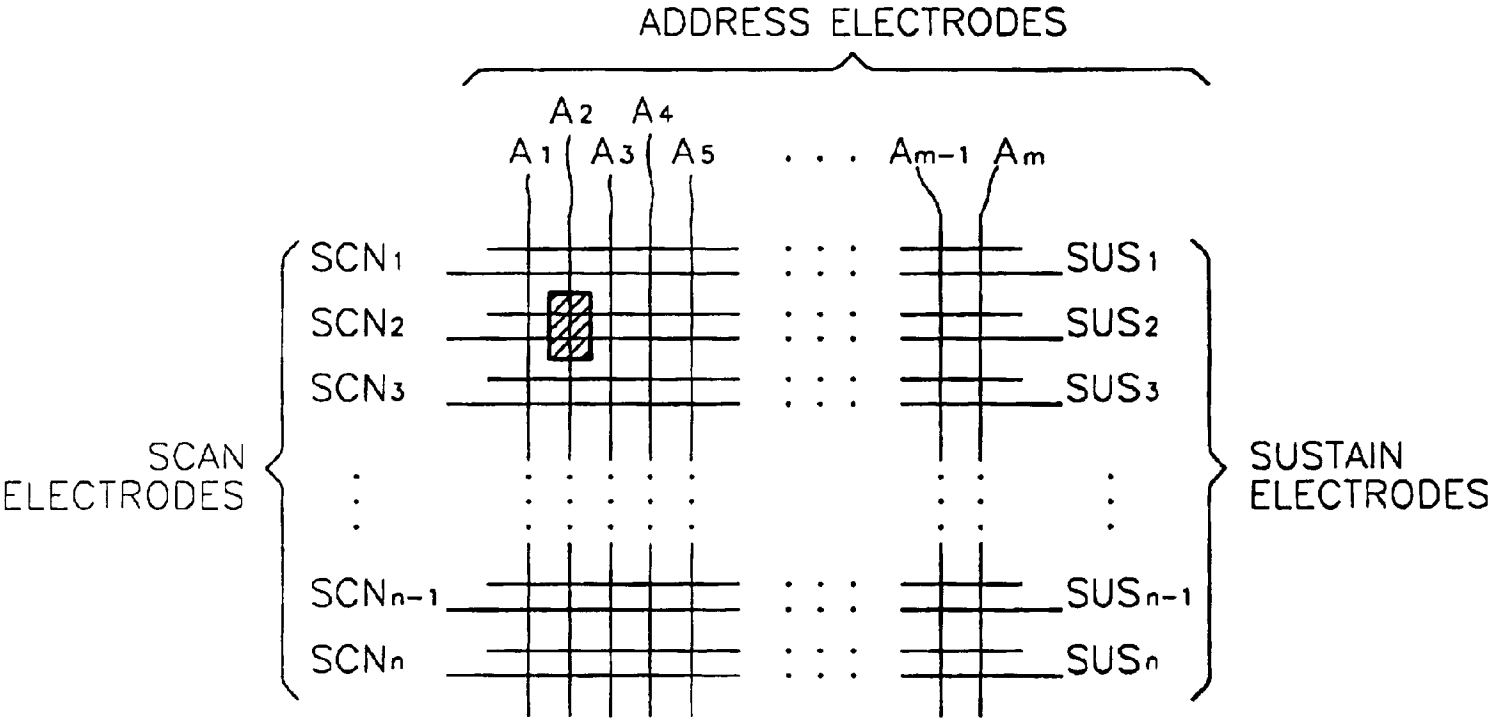
FIG. 1B is a diagram of an electrode array in a panel.

FIG. 1B is a diagram of an electrode array in a panel. Electrodes form a matrix having m columns and n rows. Address electrodes $A_1$ through $A_m$ are arrayed in columns. Scan electrodes $SCN_1$ through $SCN_n$ and sustain electrodes $SUS_1$ through $SUS_n$ are arrayed in rows. A discharge cell shown in FIG. 1B corresponds to the discharge cell 12 shown in FIG. 1A.

Figure 1C:
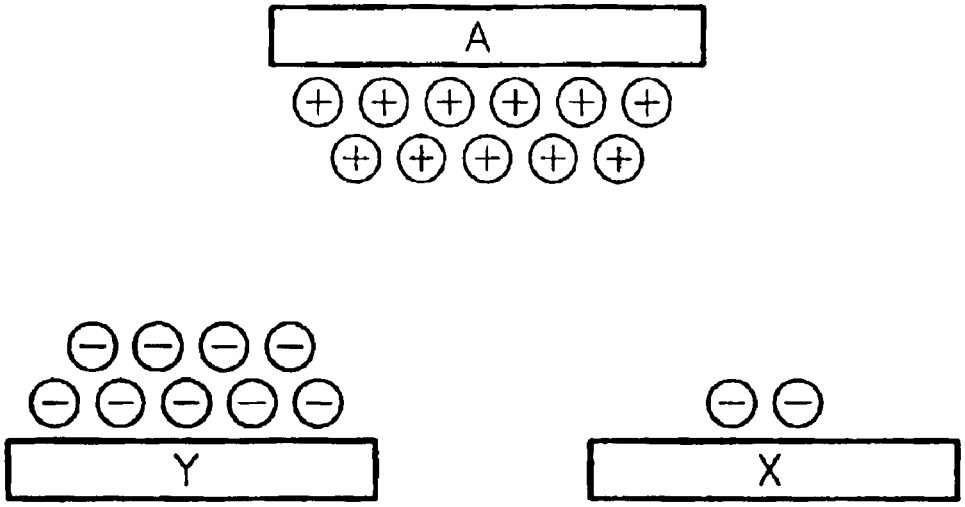
FIG. 1C is a diagram of the structure of wall charges in a discharge cell meeting addressing conditions.

FIG. 1C is a diagram of the structure of wall charges in a discharge cell meeting addressing conditions. In order to satisfy the addressing conditions in a discharge cell, a large amount of negative charges should be accumulated on a scan electrode, a large amount of positive charges should be accumulated on an address electrode, and a moderate amount of negative charges or a small amount of positive charges should be accumulated on a sustain electrode depending on the bias voltage to be applied to the sustain electrode during a scan period. Here, the "addressing conditions" means conditions that, in the scan period, a cell to turn on in a sustain period can be accurately selected. In addition, when discharge has failed in the addressed discharge cell during the scan period, enough wall charges not to provoke discharge in a subsequent sustain period should remain on the sustain electrode and the scan electrode.

Accordingly, as shown in FIG. 1C, in a cell that satisfies the addressing conditions, a large amount of negative charges should be accumulated on a scan electrode Y and a large amount of positive charges should be accumulated on an address electrode A so that enough wall charges to generate an address (write) discharge can be formed when an address voltage and a scan voltage are applied to the address electrode A and the scan electrode Y, respectively, during the scan period. Here, a moderate amount of negative charges or a small amount of positive charges may be accumulated at a sustain electrode X depending on the bias voltage applied to the sustain electrode X during the scan period.

Figure 2A:
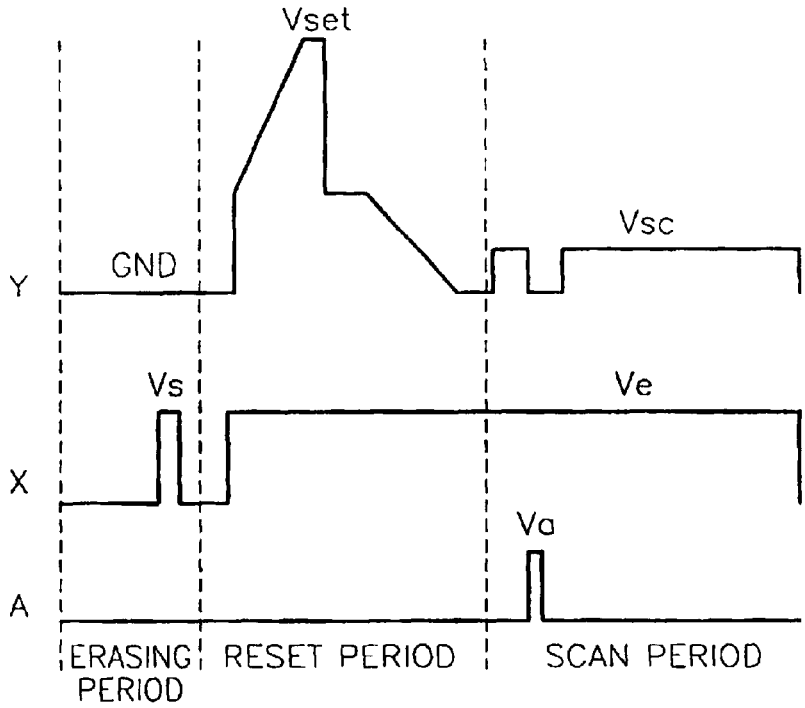
FIGS. 2A and 2B are timing charts of driving waveforms related to a method of driving a plasma display panel according to embodiments of the present invention.

FIG. 2A is a timing chart of driving waveforms related to a method of driving a plasma display panel according to a first embodiment of the present invention. In a panel driving method according to the first embodiment, one frame period may be composed of 8 subfields for 256 gray scale. Each subfield is composed of a reset (initialization) period, a scan period, a sustain period, and an erasing period. During the reset period, the state of each cell is initialized for smooth cell addressing. During the scan period, cells to be turned on are selected and wall charges are accumulated at such cells. During the sustain period, the addressed cells are discharged to actually display an image. During the erasing period, wall charges of cells are reduced to terminate a sustain discharge. It will be apparent that the first embodiment can be applied even to the case where a frame dose not have a subfield structure.

A "first reset pulse" having the waveform of an increasing ramp pulse is applied in the early stage of a reset period, and thereafter a "a second reset pulse" having the waveform of a decreasing ramp pulse is applied. Meanwhile, a predetermined voltage is applied to sustain electrodes to prevent discharges between a scan electrode and a sustain electrode due to a reset pulse applied during the reset period. For example, a constant voltage may be applied to the sustain electrodes. The constant voltage may be set to be equal to or a little higher than a sustain discharge voltage Vs during the reset period and may be set to be higher than or equal to the sustain discharge voltage Vs during a scan period. A 0 voltage may be applied to address electrodes. The detailed operations during the reset period will be described later.

Next, during a scan period, all scan electrodes are maintained at a voltage Vsc. A positive address pulse voltage +Va is applied to an address electrode corresponding to discharge cells to be displayed on a first row, and simultaneously, a scan pulse voltage of 0 V is applied to the scan electrode on the first row. Here, a voltage between the surface of the insulator layer on the address electrode and the surface of the protective layer on the scan electrode, at the intersection between the address electrode and the scan electrode, is the sum of the address pulse voltage +Va and the wall voltage between the address electrode and the scan electrode. As a result, an address discharge occurs between the address electrode and the scan electrode and between the sustain electrode and the scan electrode, at the above intersection. Accordingly, at the intersection, a positive wall charge is accumulated on the surface of the protective layer on the scan electrode, a negative wall charge is accumulated on the surface of the protective layer on the sustain electrode, and a negative wall charge is accumulated on the surface of the insulator layer on the address electrode.

A sustain period follows the scan period. During the sustain period, all the scan electrodes and all the sustain electrodes are maintained at 0 V, and then a positive sustain pulse voltage +Vs is applied to all the scan electrodes. Here, a voltage between the surface of the protective layer on the scan electrode and the surface of the protective layer on each sustain electrode, in a discharge cell in which an address discharge has occurred, is the sum of a sustain pulse voltage, a positive wall voltage formed on the surface of the protective layer on the scan electrode during the scan period, and a negative wall voltage formed on the surface of the protective layer on the sustain electrode during the scan period, which is greater than a discharge start voltage. As a result, a sustain discharge occurs between a scan electrode and a sustain electrode in a discharge cell in which the address discharge has occurred. In the discharge cell in which the sustain discharge has occurred, a negative wall charge is accumulated on the surface of the protective layer on the scan electrode, and a positive wall charge is accumulated on the surface of the protective layer on the sustain electrode. Thereafter, the sustain pulse voltage applied to the scan electrode becomes 0 V. Subsequently, a positive sustain pulse voltage +Vs is applied to all the sustain electrodes, and through the same procedure as described above, a sustain discharge occurs between a scan electrode and a sustain electrode in a discharge cell in which the address discharge has occurred. Thereafter, through the same method as described above, a positive sustain pulse voltage is alternately applied to all scan electrodes and all the sustain electrodes, thereby performing a sustain discharge. Such a sustain discharge excites phosphor, thereby generating visible rays used for displaying an image.

After the sustain period ends, during an erasing period, a square pulse having a narrow width of about 1 μsec or a ramp pulse increasing slowly is applied to all the sustain electrodes. Here, in a discharge cell in which a sustain discharge has occurred, a voltage between the surface of the protective layer on a scan electrode and the surface of the protective layer on a sustain electrode is the sum of a negative wall voltage on the protective layer on the scan electrode at the last point of the sustain period, a positive wall voltage on the protective layer on the sustain electrode at the last point of the sustain period, and the erasing pulse voltage described above. As a result, a faint erasing discharge occurs between the sustain electrode and the scan electrode in the discharge cell in which the sustain discharge has occurred. In addition, the negative wall voltage on the protective layer on the scan electrode and the positive wall voltage on the protective layer on the sustain electrode are getting weaker, thereby stopping the sustain discharge. With such arrangement, an erasing operation is completed. According to circumstances, the erasing period can be omitted.

A discharge mechanism during a reset period will be described with reference to waveforms shown in FIG. 2A. Maintaining a constant voltage at each of a sustain electrode and an address electrode, a reset pulse is applied to a scan electrode to cause a substantial reset discharge between the scan electrode and the address electrode. However, it should not be discharged between the scan electrode and the sustain electrode.

During a reset period for initializing the state of each cell before an address period, a voltage of the first reset pulse increasing at a predetermined slope is applied to the scan electrode. While the first reset pulse is being applied to the scan electrode, a voltage in a range that may not cause a discharge between the sustain electrode and the scan electrode is applied to the sustain electrode. In this period, at a certain voltage in the middle of rising portion of the first reset pulse, between the minimum and the maximum voltages of the first reset pulse, causes a discharge between the scan electrode and the address electrode. The first reset pulse can be a waveform increasing linearly, exponentially, or logarithmically.

It is preferable that the slope of the first reset pulse is set to be steep as far as the first reset pulse allows a medium discharge between the address electrode and the scan electrode while it is rising. The slope may be determined considering the length of the reset period. When the slope of the first reset pulse is steep, background brightness increases. When the slope of the first reset pulse is moderate, background brightness decreases. However, if the slope of the first reset pulse is exceedingly steep enough to be considered as a square wave shape, a discharge occurs at the maximum voltage Vset of the first reset pulse. This forms excessive wall charges and causes unnecessary strong discharges, which may damage the panel. Accordingly, the slope of the first reset pulse is set to be enough to allow a discharge between the address electrode and the scan electrode while the voltage of the first reset pulse is increasing.

It is common that the discharge starting voltages for the cells of the panel are slightly different cell by cell. Assuming that a variation range of a discharge start voltage between an address electrode and a scan electrode is Vfmin through Vfmax, a starting voltage of a first ramp pulse is V1, and an ending voltage thereof is V2, the following conditions should be satisfied when there are no wall charges on the inner wall of a cell.

$$\mathbf{V1} \leqq \mathrm{Vfmin}, \text{ and}$$

$$\mathbf{V2} \geqq \mathrm{Vfmax} \tag{1}$$

If a wall voltage has been formed due to wall charges between an address electrode and a scan electrode at the beginning of a reset period, the following conditions should be satisfied.

$$\mathbf{V1} \leqq \mathrm{Vwfmin}, \text{ and}$$

$$\mathbf{V2} \geqq \mathrm{Vwfmax} \tag{2}$$

Wherein Vwfmin and Vwfmax are respectively the lower limit and the upper limit of the voltage range that allows a discharge between the address electrode and the scan electrode.

Following the first reset pulse, a voltage of the maximum voltage value Vset of the first reset pulse can be applied to the scan electrode for a predetermined time. It is not necessary to apply the maximum voltage to the scan electrode for the predetermined time, and application time can be appropriately adjusted considering the length of the reset period.

Next, the voltage applied to the scan electrode decreases to a voltage Vr lower than the maximum voltage Vset. The voltage Vr should have a level that does not allow discharge during the voltage decrease of the scan electrode. A voltage formed by a second reset pulse decreasing at a predetermined slope from the voltage Vr is applied to the scan electrode. The second reset pulse can be realized as a waveform decreasing linearly, exponentially or logarithmically. It is preferable that the second reset pulse decreases to a low voltage of a scan pulse, which is applied during the address period. Meanwhile, before the second reset pulse is applied, a voltage of Vr can be applied to the scan electrode for a certain period in order to stabilize the operation of the circuit.

According to the first embodiment, during a first reset pulse period, a voltage exceeding the discharge start voltage between the address electrode and the scan electrode is applied between the address electrode and the scan electrode, so a discharge occurs therebetween. In contrast, a voltage lower than the discharge start voltage between the scan electrode and the sustain electrode is applied between the scan electrode and the sustain electrode, so a discharge does not occur therebetween. The discharge occurring between the address electrode and the scan electrode is a medium discharge occurring at the point that discharging conditions for each cell is satisfied as the first reset pulse voltage increases.

For example, a voltage of about 200 V is applied to the sustain electrode to prevent a discharge between the scan electrode and the sustain electrode even if a voltage applied to the scan electrode increases. Then, a first reset pulse with a slope of about 10–2500 V/μsec and an ending voltage of about 400–440 V is applied to the scan electrode. The first reset pulse causes a discharge between the scan electrode and the address electrode. Positive charges are formed on the address electrode, and negative charges are formed on the scan electrode. Completing the discharge, the scan electrode voltage drops to a predetermined level, and a constant voltage is applied to the sustain electrode. In this state, a second reset pulse decreasing toward the low level voltage of a scan pulse that is applied during a scan period is applied to the scan electrode. The second reset pulse decreases excessive wall charges formed between the electrodes to an appropriate level for address operation. As a result, a wall voltage a little lower than the discharge start voltage is formed between the scan electrode and the address electrode.

The first reset pulse in a shape of square pulse may cause a strong discharge at the maximum voltage Vset, and an unnecessary discharge when the maximum voltage decreases to the start voltage Vr of the second reset pulse. However, if a ramp pulse is used as the first reset pulse according to the present invention, a medium discharge occurs during the voltage increase, preventing an unnecessary discharge.

The reset period is followed by an address period. When a scan pulse is applied to the scan electrode and an address pulse is applied to the address electrode, a voltage applied to the electrodes and a wall voltage formed due to a reset operation are summed, thereby provoking an address discharge. Since the sustain electrode is maintained at a predetermined voltage when the address discharge occurs, a second discharge occurs between the sustain electrode and the scan electrode due to electrons attracted to and accumulated on the sustain electrode or space-charges induced by the address discharge. As a result, positive charges are formed on the scan electrode and negative charges are formed on the sustain electrode.

After the scan period, a sustain period starts. During the sustain period, a sustain discharge occurs only in the cells that have accumulated positive charges on the scan electrode and negative charges on the sustain electrode due to the address discharge during the scan period.

Figure 2B:
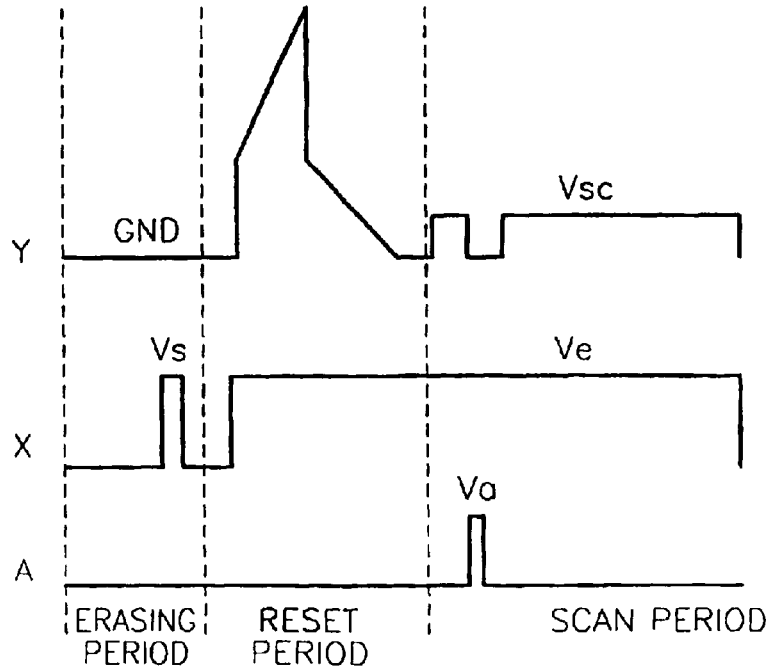

FIG. 2B is a timing chart according to a second embodiment of the present invention. In the second embodiment, a reset signal is composed of only first and second reset pulses. As described above, the maximum voltage Vset of the first reset pulse and the start voltage Vr of the second reset pulse are maintained for a predetermined time to obtain operating margin and reliability. Without the maintaining periods, basic operations are performed without any problem.

When a single frame is divided into a plurality of subfields in driving a panel, the slope and/or peak voltage of a reset pulse for a first subfield or some subfields of each frame or the slope and/or peak voltage of a reset pulse for one or more subfields of some frames among a plurality of frames can be set to be higher or lower than the slope and/or peak voltage of a reset pulse applied for the other subfields. In other words, the slopes and/or peak voltages of reset pulses applied during a reset period may be the same among all subfields or may be different according to the position of a subfield. For example, the slope of a reset pulse in a first subfield of each frame can be steeper and the peak voltage can be higher than in the other subfields. In addition, a square pulse instead of a first ramp pulse can be applied during the reset period of some subfields.

Figure 3A:
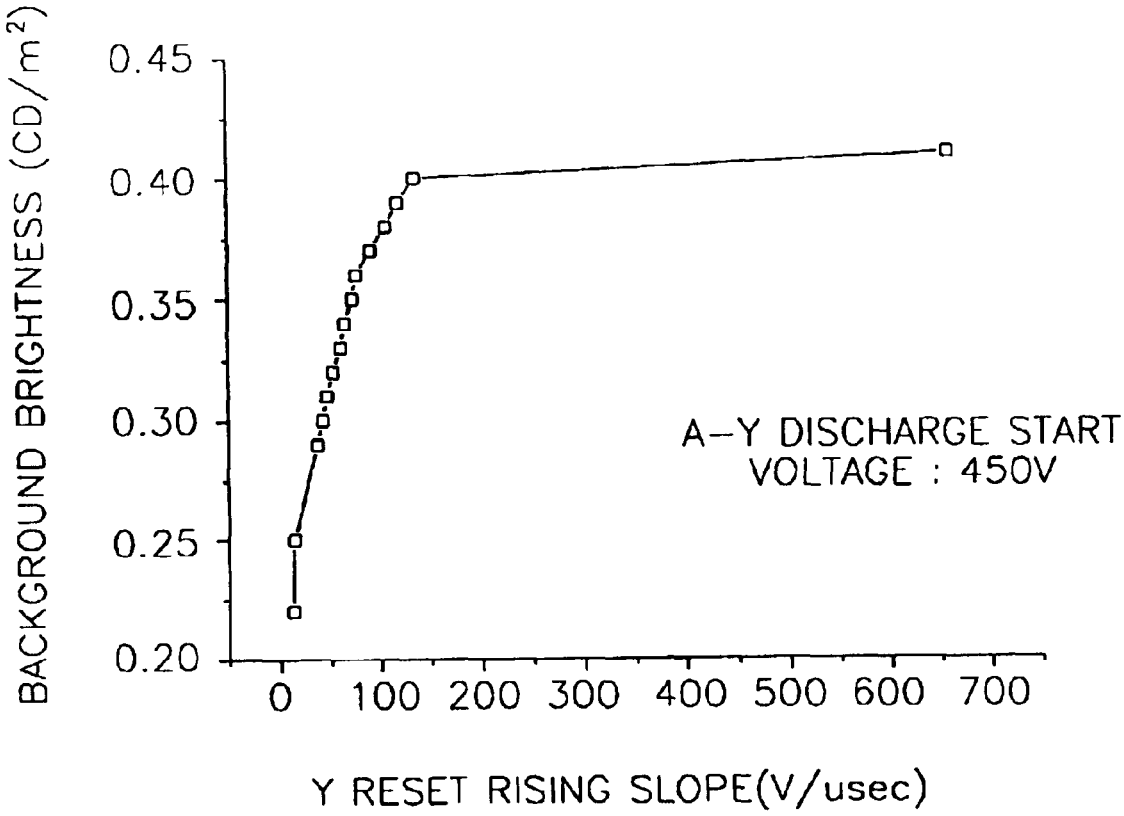

FIGS. 3A and 3B are a graph and a table, respectively, which show the relationship between the rising slope of a first ramp pulse during a reset period and the intensity of the background brightness. An address electrode was maintained at 0 V, and a first ramp pulse with a peak value of 450 V was applied to a scan electrode, thereby provoking a discharge. FIGS. 3A and 3B show measured background brightness according to the discharge in view of the slope of the first ramp pulse. It can be derived that a strong discharge occurs as brightness is high. In this test, background brightness was measured while changing the slope of the first ramp pulse applied to the scan electrode.

It can be seen that the brightness has a nearly constant value of about 0.4 cd/m$^2$ when the slope is 657 through 134 V/$\mu$sec. In other words, when the slope of the first ramp pulse is at least 130 V/$\mu$sec, the background brightness is almost constant at about 0.4 cd/m$^2$ even if the slope is steeper. When the slope of the first ramp pulse is less than 130 V/$\mu$sec, the background brightness decreases as the slope is decreases. For example, the brightness is 0.38 cd/m$^2$ when the slope is 106 V/$\mu$sec, the brightness is 0.35 cd/m$^2$ when the slope is 73 V/$\mu$sec, the brightness is 0.31 cd/m$^2$ when the slope is 47 V/$\mu$sec, and the brightness is 0.25 cd/m$^2$ when the slope is 14 V/$\mu$sec. Accordingly, in the second embodiment, background brightness desired by a designer can be obtained by setting the slope of the first ramp pulse to a proper value lower than 130 V/$\mu$sec. A designer can set background brightness to a proper value considering the relation between the brightness and contrast and then obtain the slope and peak value of a ramp pulse for the set background brightness. Meanwhile, since the reset period becomes longer as the slope decreases, it is necessary to consider both the intensity of the background brightness and the length of the reset period.

Figure 4A:
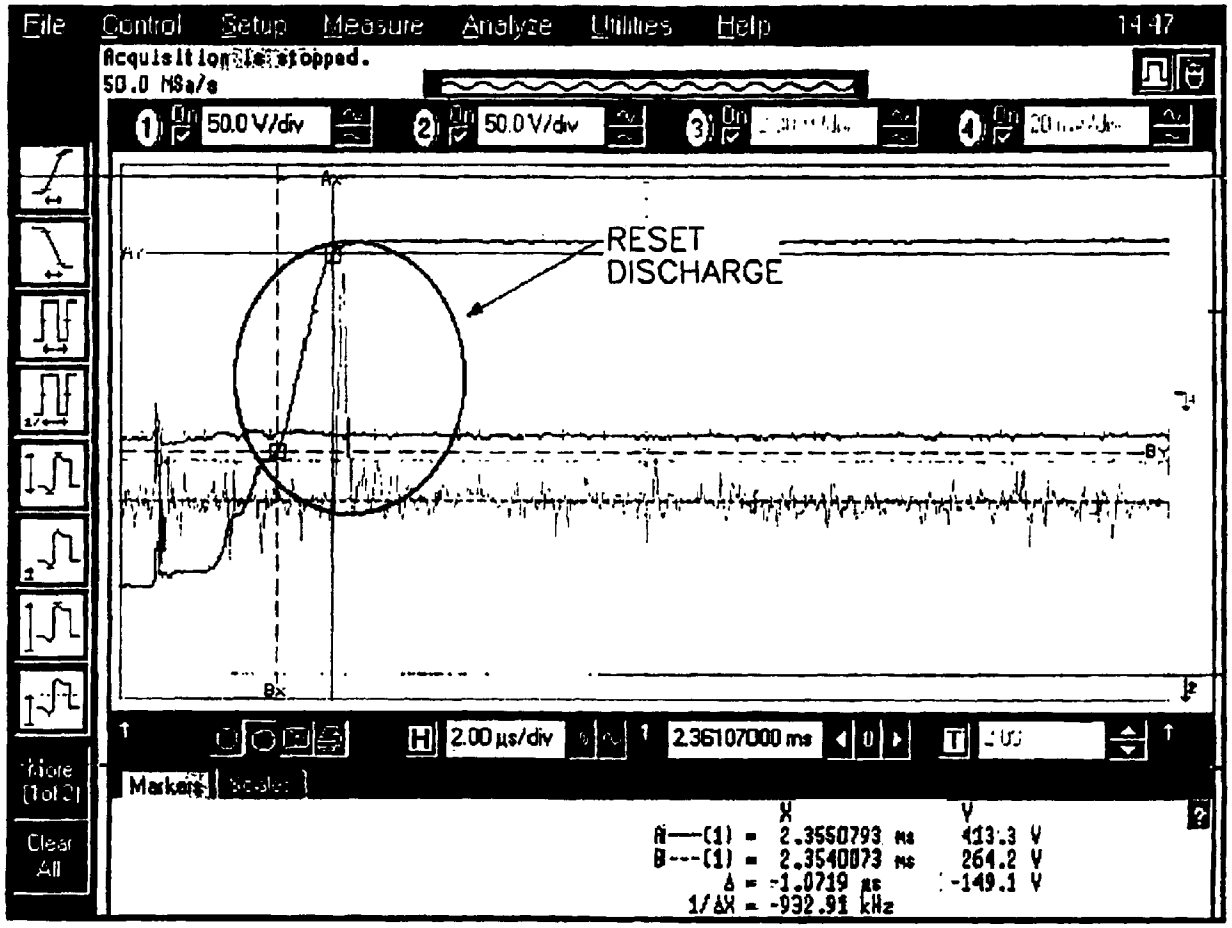
FIGS. 4A, 4B and 4C are graphs of surveyed reset discharges occurring in a single green cell.
Figure 4B:
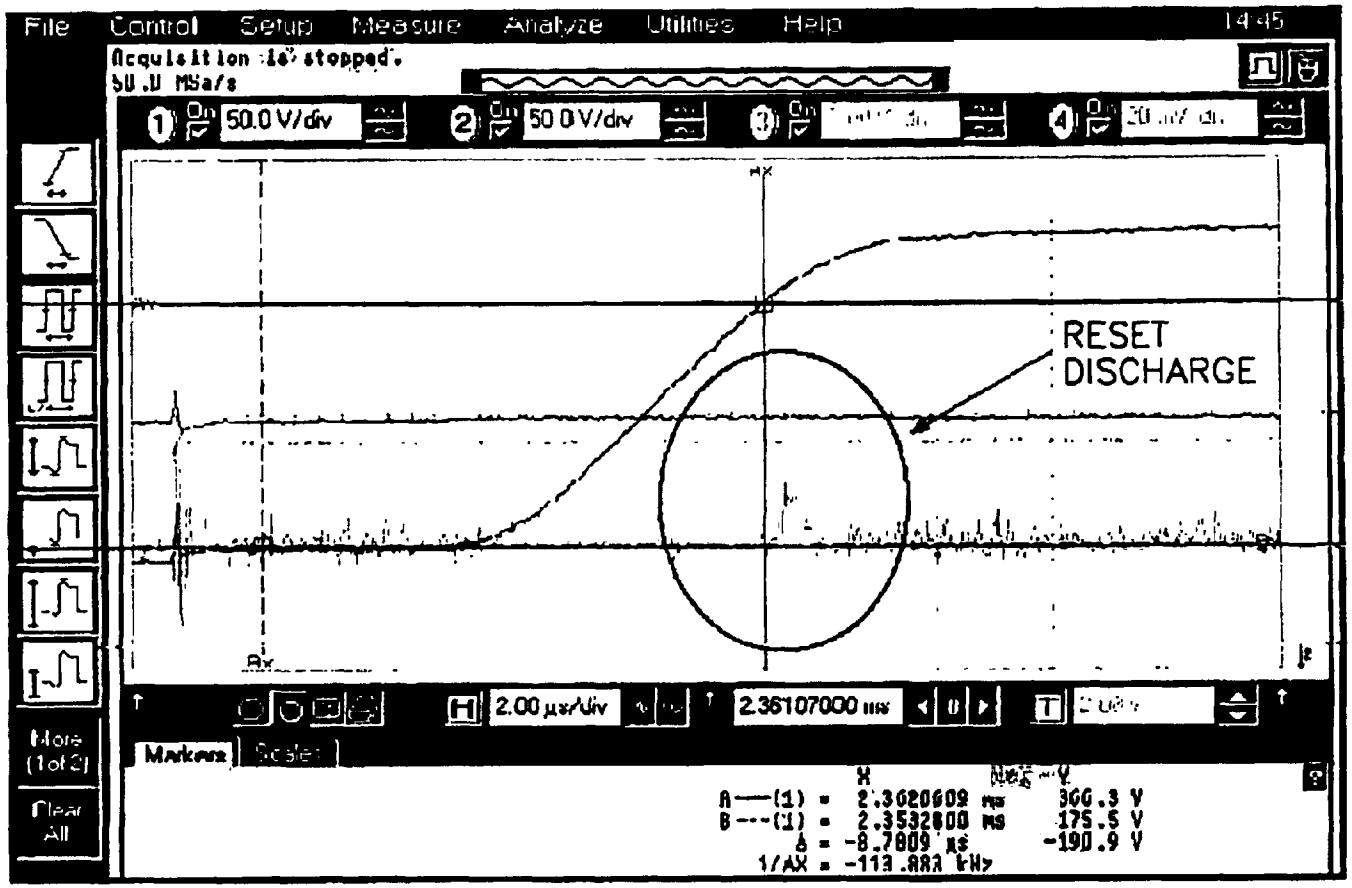
Figure 4C:
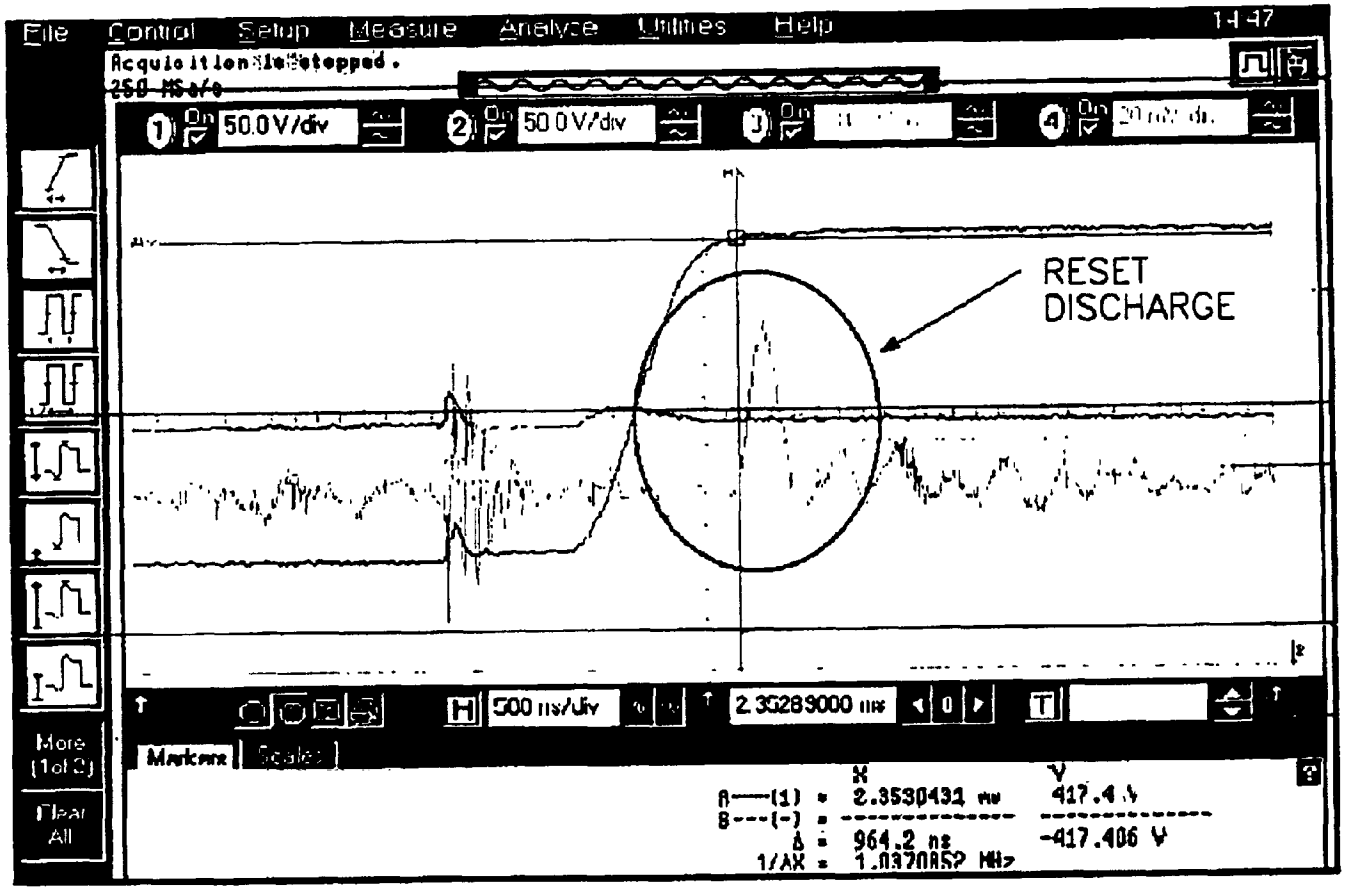

FIGS. 4A, 4B and 4C are graphs of surveyed reset discharges occurring in a single green cell. FIG. 4A shows the result of a test in which the slope of the first ramp pulse was set to 157 V/$\mu$sec. It can be seen that a reset discharge occurs at the voltage in the vicinity of boundary between the rising portion of the ramp pulse and an externally applied voltage portion. Accordingly, if the slope of the first ramp pulse is set to lower than 157 V/$\mu$sec, a medium discharge can be provoked during an increase in the ramp pulse. If the slope of the first ramp pulse is set to be higher than 157 V/$\mu$sec, a strong discharge occurs due to then externally applied voltage corresponding to the peak of the ramp pulse. FIG. 4B shows the result of a test in which the slope of the first ramp pulse was set to about 40 V/$\mu$sec. It can be seen that a reset discharge occurs in the middle of an increase in the ramp pulse and the intensity of the discharge is less than in the case of FIG. 4A. FIG. 4C shows the result of a test in which the slope of the first ramp pulse was set to about 400 V/$\mu$sec. It can be seen that a reset discharge is very strong due to an externally applied voltage.

Figure 5A:
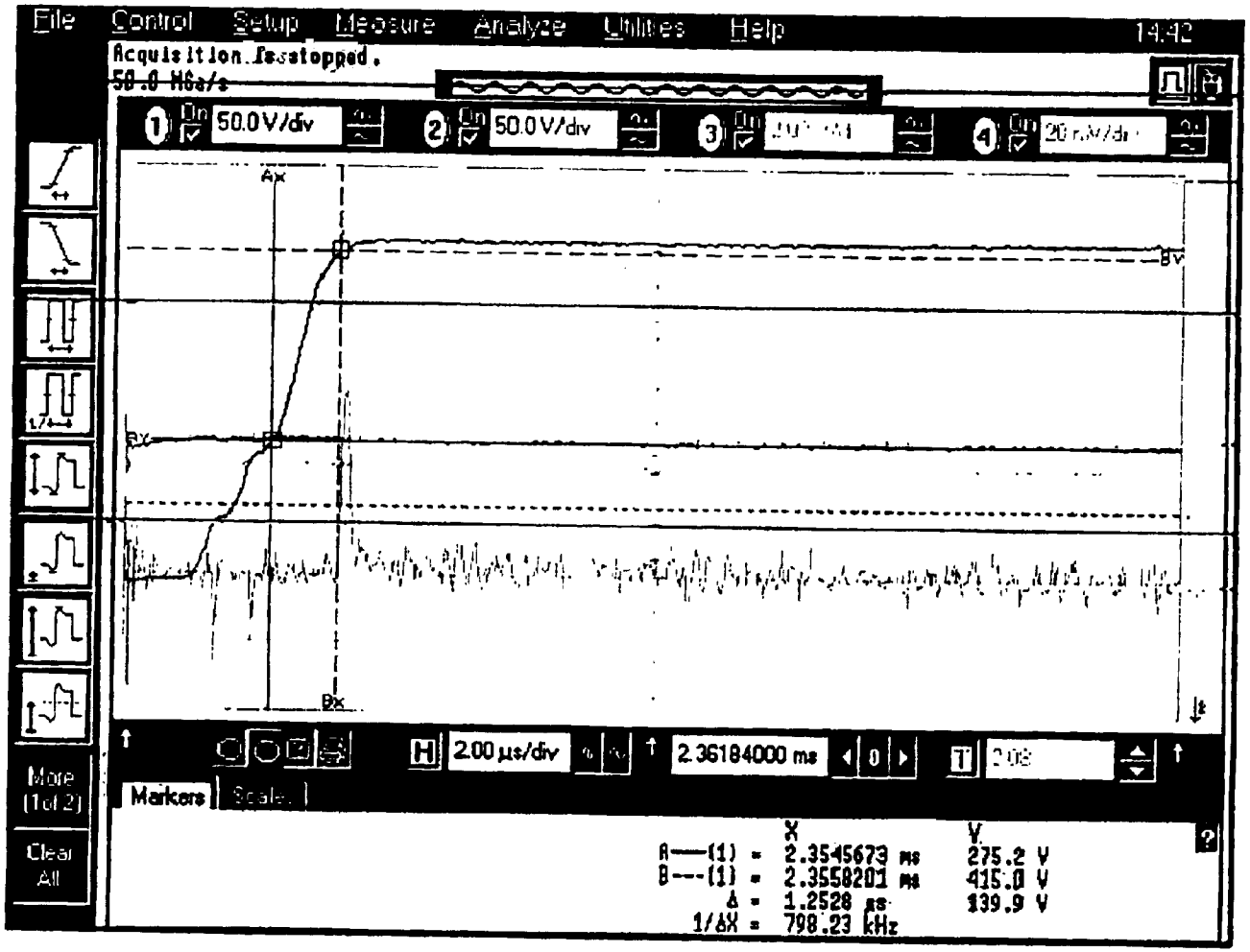
FIGS. 5A and 5B are graphs of surveyed reset discharges occurring in a single blue cell.
Figure 5B:
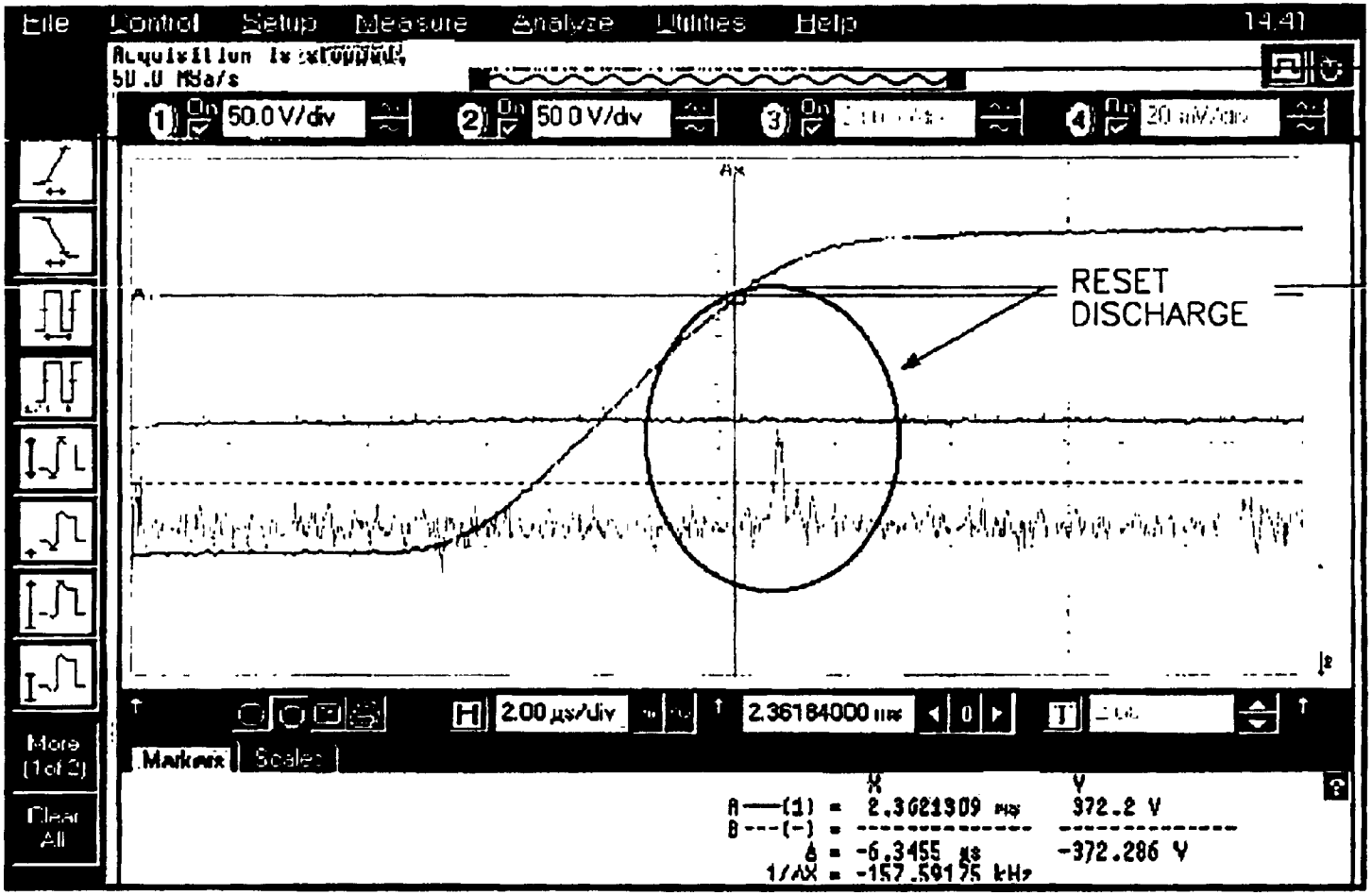

FIGS. 5A and 5B are graphs of surveyed reset discharges occurring in a single blue cell. FIG. 5A shows the result of a test in which the slope of the first ramp pulse was set to 112 V/$\mu$sec. It can be seen that a reset discharge occurs at the voltage in the vicinity of boundary between the rising portion of the ramp pulse and an externally applied voltage portion. Accordingly, if the slope of the first ramp pulse is set lower than 112 V/$\mu$sec, a medium discharge can be provoked during an increase in the ramp pulse. If the slope of the first ramp pulse is set to be higher than 112 V/$\mu$sec, a strong discharge occurs due to then externally applied voltage corresponding to the peak of the ramp pulse. FIG. 5B shows the result of a test in which the slope of the first ramp pulse was set to about 65 V/$\mu$sec. It can be seen that a reset discharge occurs in the middle of an increase in the ramp pulse and the intensity of the discharge is less than in the case of FIG. 5A.

Referring to FIGS. 4A, 4B, 4C, 5A and 5B, it can be inferred that the range of the slope or voltage of the first ramp pulse allowing a medium discharge varies depending on the discharge characteristics of each cell. Accordingly, in order to provoke a middle discharge during a reset period, the slope of the first ramp pulse should be set within a range allowing a discharge in the medium of the increase in the first ramp pulse, considering the characteristics of a panel, and preventing a strong discharge due to an externally applied voltage after the increase in the first ramp pulse. Even if the slope of the first ramp pulse is appropriately set for a medium discharge as described above, it is required to adjust the slope and peak value of the first ramp pulse to achieve the intended background brightness.

Meanwhile, the first reset pulse can be set to have at least two slopes considering the discharge characteristics of a cell. In other words, a medium discharge can be achieved while decreasing the length of a reset period, by setting the first slope of the first reset pulse very steep within a voltage range that may not cause a medium discharge and setting the second slope thereof relatively moderate in a voltage range that causes a medium discharge.

Figure 6A:
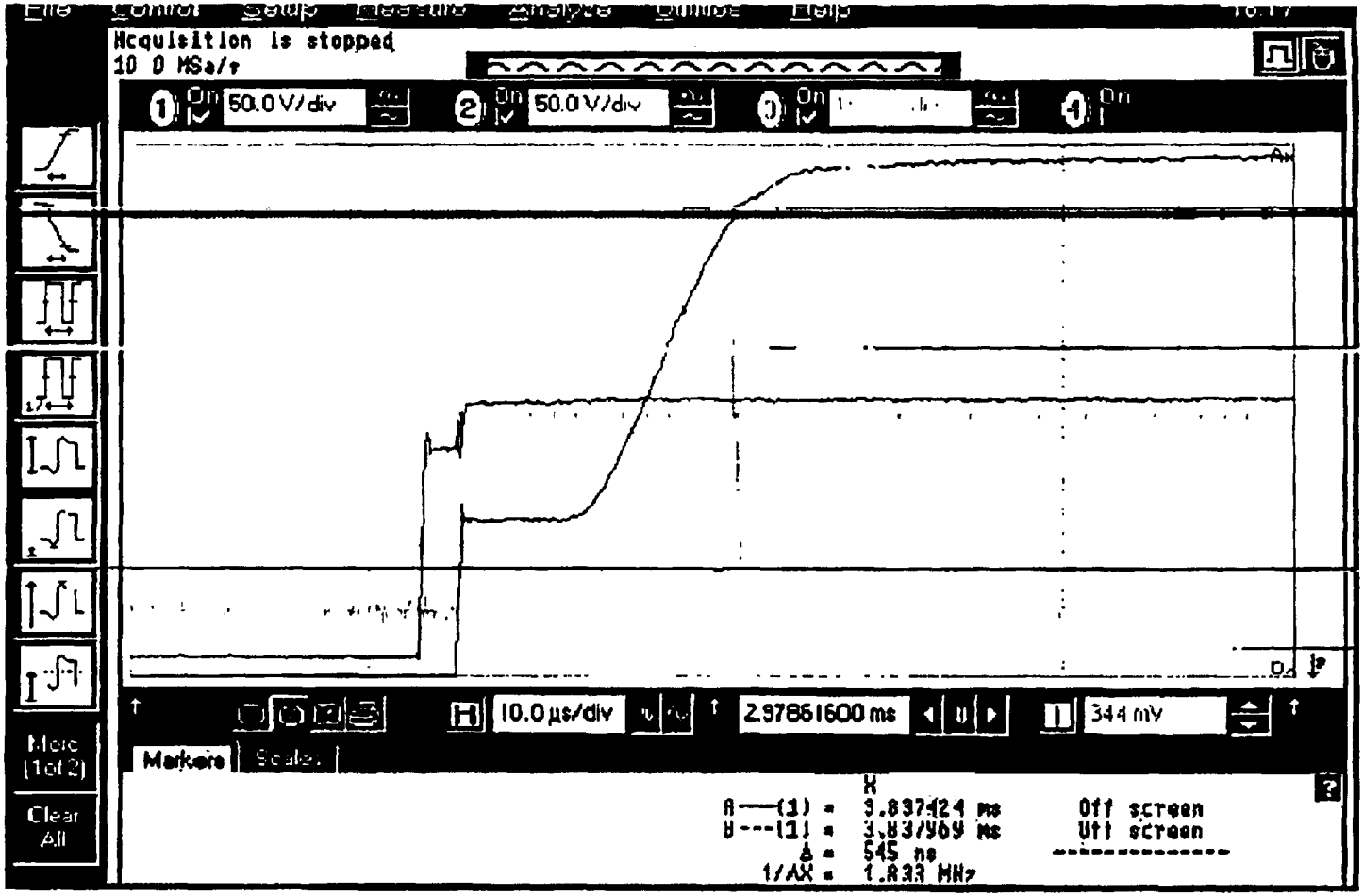
FIGS. 6A and 6B are graphs of optical powers measured with respect to a single cell during a reset period.
Figure 6B:
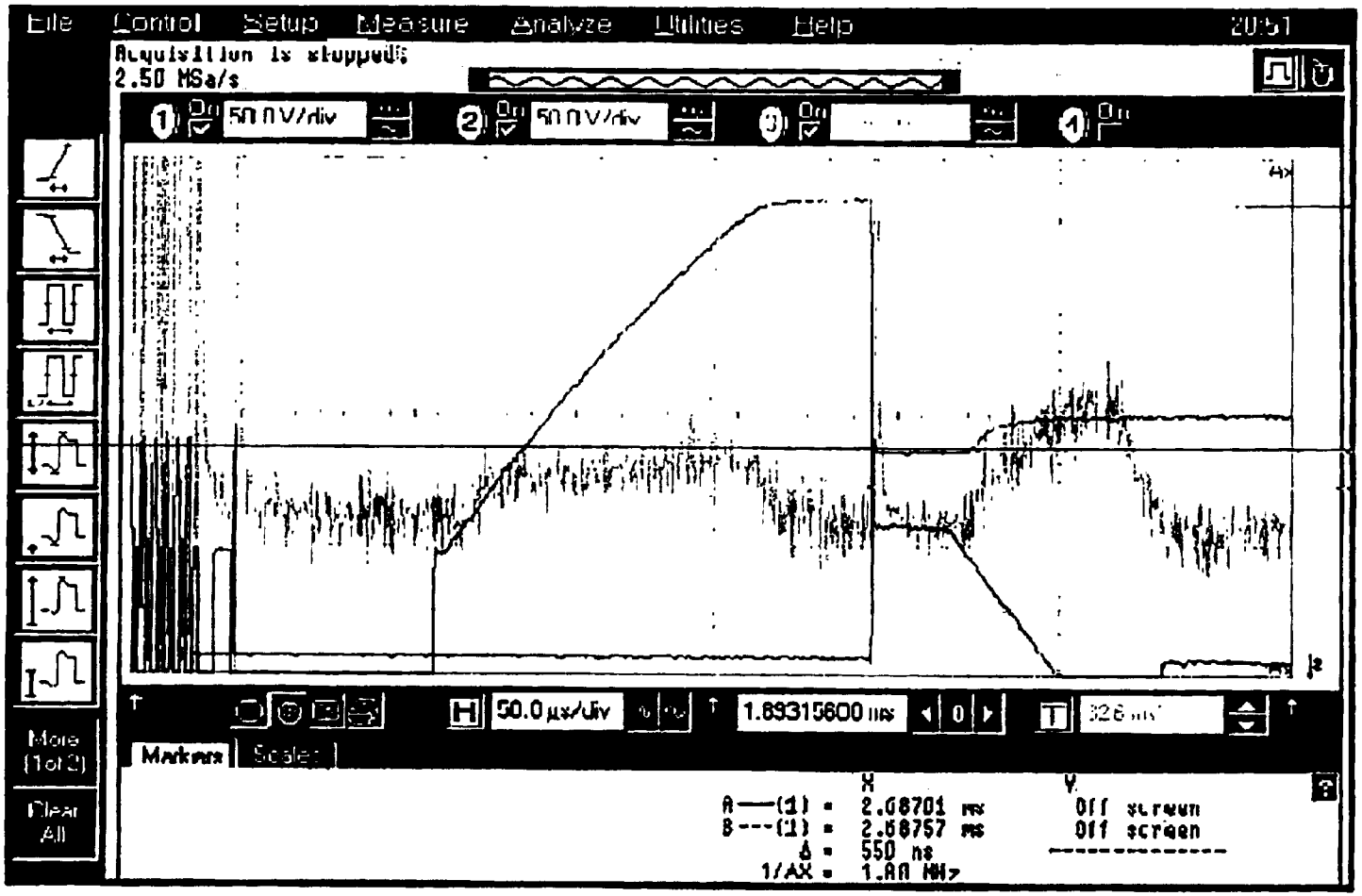

FIGS. 6A and 6B are graphs of optical powers measured with respect to a single cell during a reset period. Since an optical power characteristic is similar to the characteristic of the intensity of a discharge, the number of discharges and their intensities can be derived from the optical power characteristic. FIG. 6A shows a case where a reset signal according to the present invention is applied. It shows that a medium discharge occurs as a reset discharge during an increase in a ramp pulse and two reset discharges occur in a single cell. In other words, a plurality of optical power peaks can appear in a single cell according to the slope of the ramp pulse and the characteristics of a panel. In addition, unlike a primary discharge, a secondary discharge occurs by mere voltage increase of about 80 V. When a square pulse rather than a ramp pulse is used as a reset pulse to provoke a discharge, wall charges formed during the primary discharge counterbalance an external electric field. Therefore, the secondary discharge cannot be achieved by mere voltage changes of 80 V.

Figure 7A:
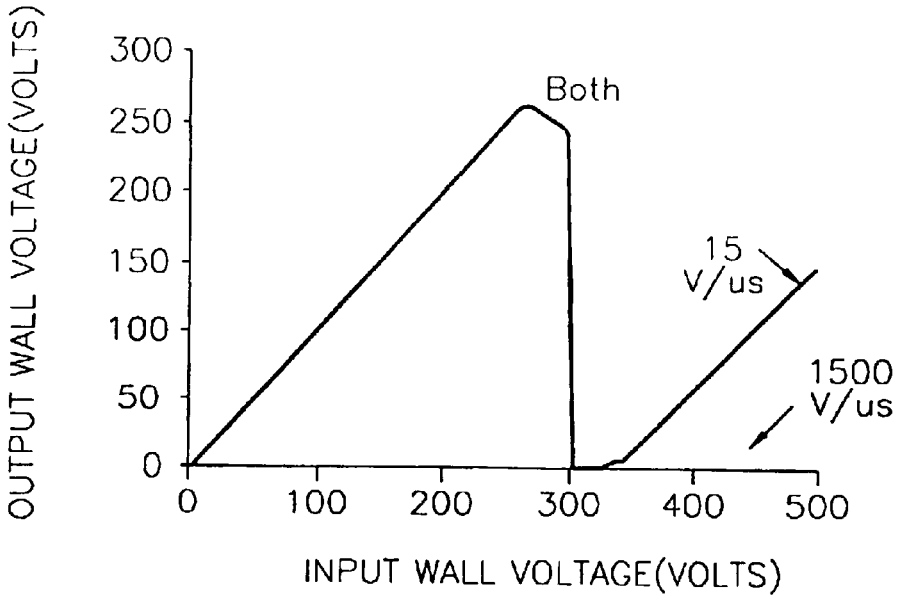
FIGS. 7A, 7B, and 7C are graphs showing wall charge characteristics resulting from a discharge occurring during a reset period.

FIG. 7A is a graph showing wall charge characteristics when a strong discharge occurs during a reset period and when a medium discharge occurs during a reset period. For example, when a strong discharge is provoked by applying a ramp pulse (substantially a square pulse) having an exceedingly steep slope of 1500 V/μsec during a reset period, an output wall voltage becomes 0 V, thereby shielding an external electric field. However, when a first ramp pulse with a slope (for example, 15 V/μsec) that allows a medium discharge is applied during a reset period according to the present invention, the reset discharge is not intense, so an external electric field is not completely shielded.

When a first ramp pulse having a slope of, for example, 62 V/μsec is applied to a scan electrode and a predetermined voltage is applied to a sustain electrode according to the present invention, an optical power decreases by about 20% compared to the case where a square pulse is applied to a scan electrode, thereby decreasing the intensity of a discharge. This prevents damage to an address electrode. In addition, since it is possible to set the slope of the first ramp pulse to be steep to some extent, a reset period can be reduced. Since a discharge between a scan electrode and a sustain electrode can be extremely suppressed, an unnecessary discharge can be suppressed, thereby improving the contrast.

Figure 7B:
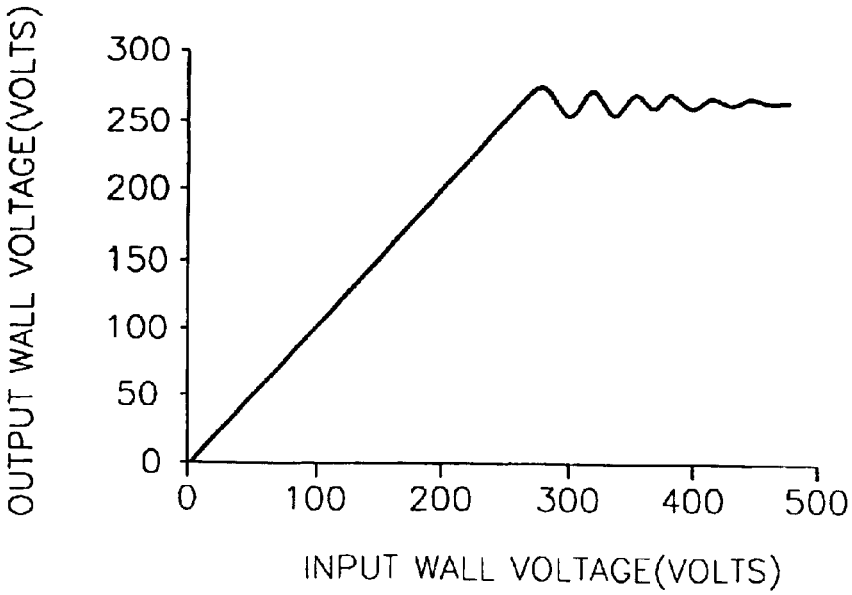

FIG. 7B is a graph showing wall charge characteristics when a panel operates in a weak discharge mode during a reset period according to conventional technology. According to the conventional technology, when a wall voltage between a scan electrode and a sustain electrode exceeds a discharge start voltage, a weak reset discharge occurs and ends immediately. Thereafter, if an applied voltage increases and exceeds the discharge start voltage, a weak discharge newly occurs. Such a weak discharge occurs periodically. An optical power generated in a cell due to such a weak discharge is shown in FIG. 6B.

FIG. 6B shows an optical power according to a conventional weak discharge. According to conventional technology using a ramp pulse, when the voltage of the ramp pulse increases linearly, weak reset discharges consecutively occurs between a scan electrode and a sustain electrode while keeping at a voltage near a discharge start voltage, thereby forming wall charges. The waveform of an optical power in FIG. 6B shows that reset discharges occur consecutively and the magnitudes of their optical powers are very small. FIG. 7B is a graph showing wall charge characteristics during a reset period in a panel driving method showing the optical power characteristic of FIG. 6B. As shown in FIG. 7B, an output wall voltage on the vertical axis hovers around a discharge start voltage and consecutively provokes weak reset discharges. In such a reset discharge, a high voltage should be applied to a scan electrode in order to form wall charges for smooth address operation. Moreover, unnecessary discharges between a scan electrode and a sustain electrode result in a poor contrast and a longer reset period.

However, referring to FIG. 6A, the reset discharge according to the present invention generates not consecutive weak discharges but at least one medium discharge using a slope of a voltage satisfying discharge conditions of a cell. Here, while the reset discharge shields an external electric field, it does not allow a discharge start voltage to be maintained. In addition, wall charges are not formed enough to completely shield off the external electric field.

Figure 7C:
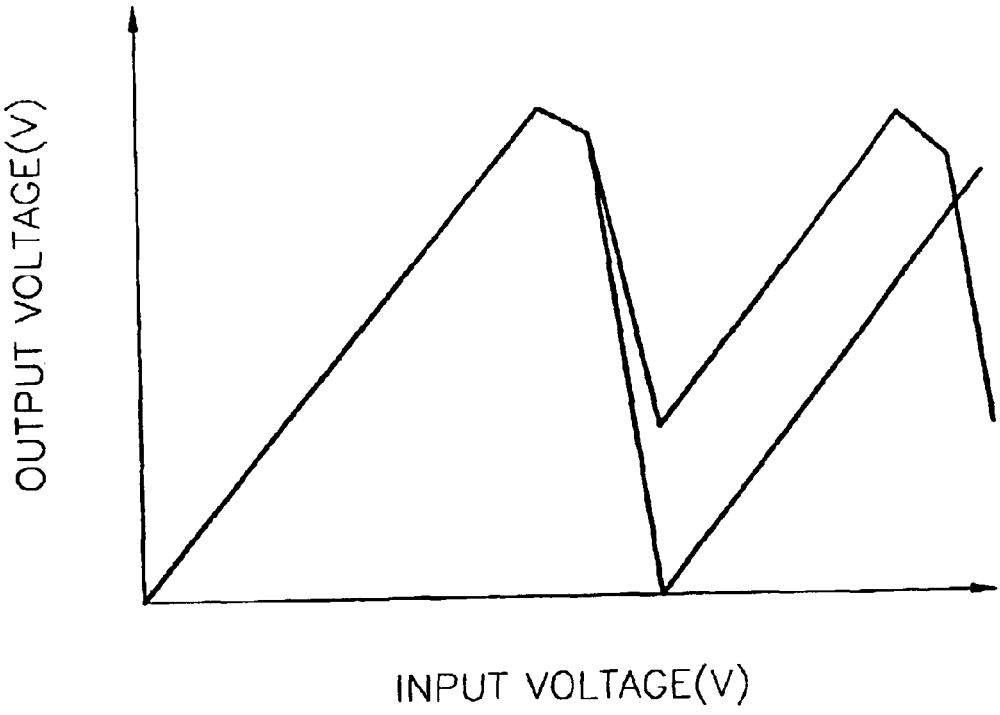

FIG. 7C is a graph showing wall charge characteristics according to the present invention. In FIG. 6A, there is a potential difference, of 80 V between a primary discharge and a secondary discharge in a single cell. If an external electric field is completely shielded during the primary discharge, a voltage should be increased by a discharge start voltage in order to provoke the secondary discharge. However, the secondary discharge is provoked by an increase in the voltage by about 80 V. This means that the electric shield by wall charges induced by the primary discharge is not very large. That is, the intensity of a discharge according to the present invention is lower than in the case using a square-wave reset signal.

According to the present invention, as wall charges induced by a primary discharge partially shield an external electric field. A slight voltage increase less than a discharge start voltage can provoke a secondary discharge. However, it is preferable to prevent an additional discharge from occurring, once wall charges accumulated on electrodes satisfy addressing conditions after the medium discharge in a certain cell during a reset period. This prevents unnecessary increase in the background brightness.

A discharge during a reset period depends on the physical characteristics of a cell in relation to the ending voltage and the slope of the pulse. The ending voltage of the applied pulse may be determined depending on the magnitude of a wall voltage to be induced on an electrode by a reset discharge. In other words, in order to induce a wall voltage of Vw1, the ending voltage is set to a voltage of at least Vw1+Vf (A-Y discharge start voltage). When a wall voltage induced by a primary discharge during the reset voltage increase is high enough, a secondary discharge does not occur until the reset pulse reaches the ending voltage after the primary discharge. In contrast, if a wall voltage induced by a primary discharge is not high enough, a second discharge may occur as the reset pulse voltage increases.

If the wall voltage after the secondary discharge does not reach the desirable magnitude, a third discharge may occur. For example, when it is assumed that the ending voltage of a reset pulse is Vrstf, if a wall voltage formed after the reset pulse increases to the ending voltage does not exceed Vrstf−Vf(A-Y discharge start voltage), more discharges may be provoked by the reset pulse. If the wall voltage exceeds Vrstf−Vf, a discharge is not provoked any more. Accordingly, the medium discharge mode according to the present invention allows a desirable amount of wall charges to be formed.

According to a conventional method, a discharge is provoked between a scan electrode and a sustain electrode during a reset period so that wall charges can be accumulated on an address electrode. According to the present invention, a reset discharge is provoked between an address electrode and a scan electrode by applying a ramp pulse and the reset discharge is provoked in the middle of the slope of the ramp pulse, thereby suppressing an excessively strong discharge and provoking a medium discharge that is suitable for the discharge characteristics of a cell. The potential difference between the address electrode and the scan electrode gradually increases, and a medium discharge occurs when the potential difference satisfies the discharge conditions of the cell. In FIG. 7C, the amount of wall charges formed after the primary discharge depends on the slope of a first ramp pulse. In addition, a degree at which an output wall voltage decreases after the primary discharge depends on the slope of the first ramp pulse. Accordingly, the intensity of a reset discharge can be adjusted by the slope of the first ramp pulse as a variable parameter.

Figure 8A:
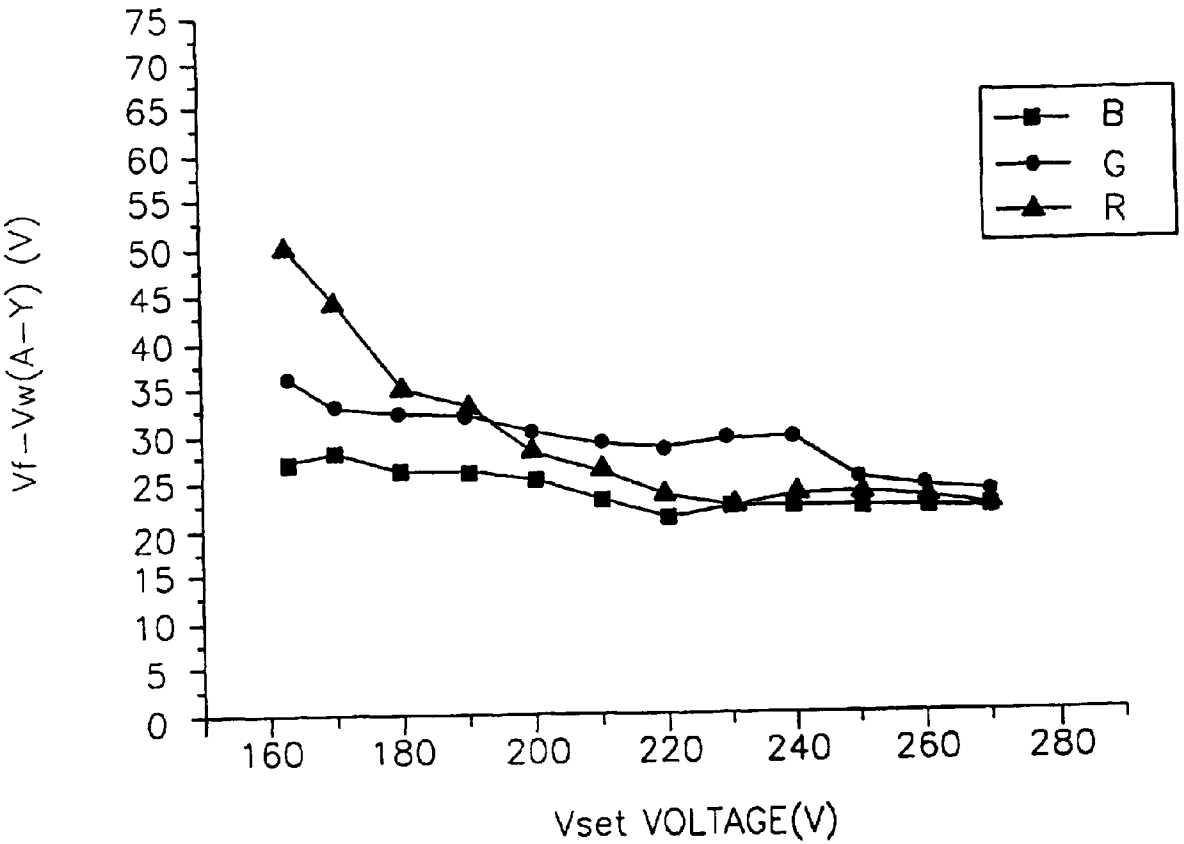
FIGS. 8A and 8B are graphs showing the relationship between a reset pulse voltage and an address voltage.
Figure 8B:
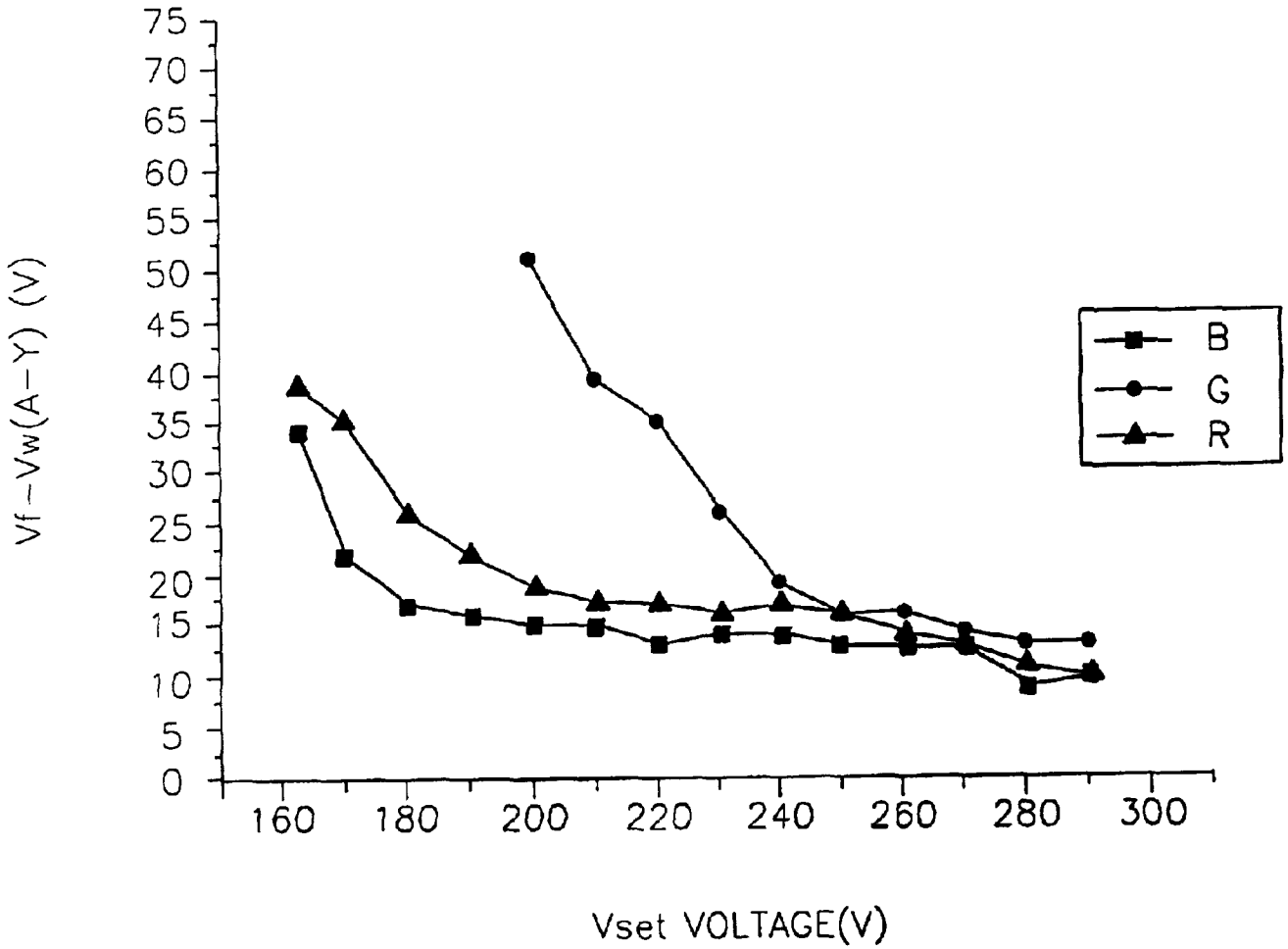

FIGS. 8A and 8B are graphs showing the relationship between a reset pulse voltage and an address voltage. The graphs are provided to inspect an external voltage (an address voltage) which should be applied between an address electrode and a scan electrode during a scan period in order to provoke an address discharge when a predetermined reset pulse voltage has been applied during a reset period. In other words, each of the graphs shows the state of a wall voltage formed between the scan electrode and the address electrode immediately before an address operation is performed after a reset operation has been completed. The horizontal axis shows a peak voltage of a reset pulse applied during the reset period, and the vertical axis shows an external voltage that should be applied between the address electrode and the scan electrode in order to provoke an address discharge during the scan period. In FIGS. 8A and 8B, the three graphs are corresponding to Red, Green, and Blue (RGB) phosphors, respectively, that is, a triangle denotes R, a circle denotes G, and a square denotes B.

Vf−Vw(A-Y) is shown at the vertical axis. Here, Vf denotes a discharge start voltage, Vw(A-Y) denotes a wall voltage formed by wall charges accumulated between the address electrode and the scan electrode. In other words, when a particular reset pulse voltage is applied during the reset period, if an external voltage corresponding to the reset pulse voltage is applied during the scan period, the discharge start voltage is formed between the address electrode and the scan electrode. If at least the external voltage is applied, the address discharge occurs. Accordingly, as the value of the vertical axis gets closer to zero, sufficiently many wall charges are formed between the address electrode and the scan electrode after a reset discharge so that a wall voltage due to the wall charges is closer to the discharge start voltage. In contrast, as the value of the vertical axis gets greater, a wall voltage formed between the address electrode and the scan electrode after the reset discharge is lower, so a higher external voltage should be applied between the address electrode and the scan electrode in order to provoke an address discharge.

FIG. 8A shows a case where the slope of the first reset pulse of FIG. 2A is set to be very steep. A square wave like signal is input and provokes a strong discharge during a reset period. FIG. 8B shows a case where the first reset pulse having an appropriate slope is applied, thereby provoking a medium discharge during a reset period.

After the reset period, wall charges necessary for an address discharge are formed on the address electrode and the scan electrode. Positive charges are formed on the address electrode, and the negative charges are formed on the scan electrode. During the scan period, a higher voltage is applied to the address electrode than to the scan electrode, so a discharge occurs between the address electrode and the scan electrode. In FIG. 8A, when the reset pulse voltage of the horizontal axis is 200 V and if the external voltage of the vertical axis is 30 V, in order to provoke an address discharge at least 30 V should be applied between the address electrode and the scan electrode during the scan period after a reset operation.

In the case of FIG. 8A, a wall voltage, which is about 20–30 V lower than a discharge start voltage between the scan electrode and the address electrode, is formed between the scan electrode and the address electrode right before the scan period. Accordingly, it can be inferred that an address discharge can be provoked if a voltage of 20–30 V is applied between the scan electrode and the address electrode during the scan period. Meanwhile, in the case of FIG. 8B, a wall voltage, which is about 10–15 V lower than a discharge start voltage between the scan electrode and the address electrode, is formed between the scan electrode and the address electrode right before the scan period. Accordingly, it can be inferred that an address discharge can be provoked if a voltage of 10–15 V is applied between the scan electrode and the address electrode during the scan period. For achieving a smooth address operation, it is preferable that a wall voltage formed between the address electrode and the scan electrode by a reset discharge is as high as possible (but is lower than the discharge start voltage therebetween). Accordingly, referring to FIG. 2A, it can be inferred that it is advantageous to realize the first reset pulse using a ramp pulse having an appropriate slope rather than using a square wave.

Figure 9:
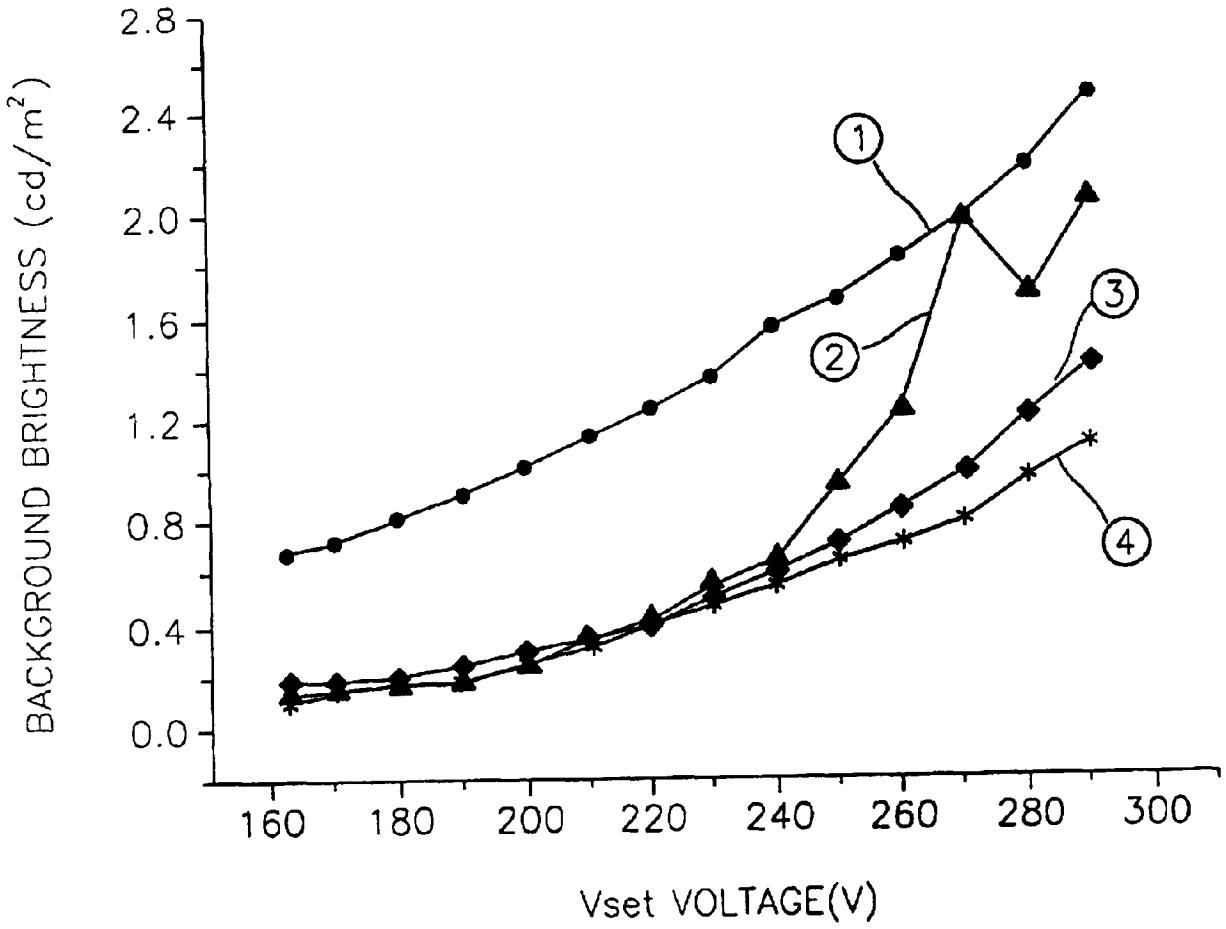
FIG. 9 is a graph showing the relation between a reset pulse and a background brightness influencing contrast.

FIG. 9 is a graph showing the relation between a reset pulse and background brightness influencing contrast. The lower background brightness means a higher contrast. A graph (1) marked by circles shows a case where application of a reset pulse according to conventional technology results in a weak discharge mode. A graph (2) marked by triangles shows a case where a square wave (for example, a square wave having a slope of at least 2500 V/μsec) is used for the first reset pulse of FIG. 2A. A graph (3) marked by quadrangles shows a case where the slope of the first reset pulse is 65 V/μsec. A graph (4) marked by "x" shows a case where the slope of the first reset pulse is 17 V/μsec.

Referring to FIG. 9, the background brightness is highest in the conventional weak discharge mode. The background brightness is second highest when using a square wave for a reset pulse. The background brightness is lowest when a reset ramp pulse realizes a middle discharge mode. Consequently, contrast can be improved by realizing a reset signal according to the present invention.

Figure 10:
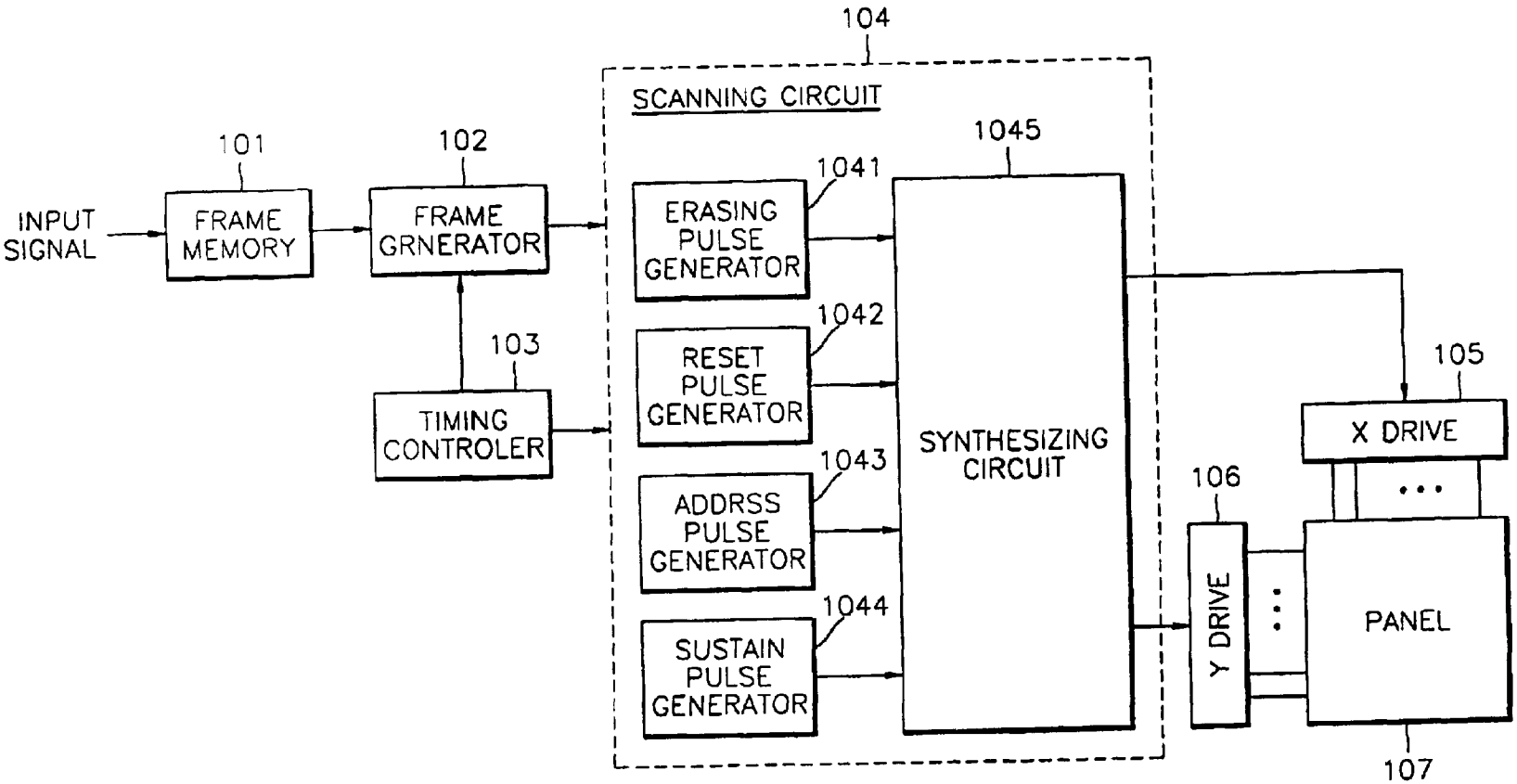
FIG. 10 is a block diagram of an apparatus for driving a plasma display panel according to an embodiment of the present invention.

FIG. 10 is a block diagram of an apparatus for driving a plasma display panel according to an embodiment of the present invention. An analog image signal to be displayed on a panel 107 is converted into digital data and stored in a frame memory 101. A frame generator 102 divides the digital data stored in the frame memory 101 at necessity and outputs the divided digital data to a scanning circuit 104. For example, for gray scale on the panel 107, the frame generator 102 divides a single frame of pixel data stored in the frame memory 101 into a plurality of subfields according to a gray level and outputs data for each subfield.

A scanning circuit 104 scans a scan electrode (Y) driver 106 and a sustain electrode (X) driver 105 of the panel 107 and includes a reset pulse generator 1042, an address pulse generator 1043, a sustain pulse generator 1044 and an erasing pulse generator 1041, for generating signal waveforms applied to electrodes during a reset period, an address period, a sustain period, and an erasing period, respectively. The reset pulse generator 1042 generates a reset signal for initializing the state of each cell. The address pulse generator 1043 generates an address signal to select cells to be turned on and to perform an addressing operation. The sustain pulse generator 1044 generates a sustain signal for discharging the cells which have been addressed by the address pulse generator 1043. The erasing pulse generator 1041 generates erasing pulses for erasing wall charges accumulated on electrodes by a sustain discharge. The scanning circuit 104 also includes a synthesizing circuit 1045 for synthesizing the above signals and applying the synthesized signal to each electrode. A timing controller 103 generates a variety of timing signals necessary for the operations of the frame generator 102 and the scanning circuit 104.

The following description concerns operations for driving a panel according to an embodiment of the present invention, and particularly, operations during a reset period. It will be noted that the waveforms, operations, or set voltage during the reset period described referring to FIG. 2A or 2B may also be applied to the apparatus. During the other periods, the panel can be driven by a typical method, and thus a detailed description thereof will be omitted.

The reset pulse generator 1042 applies a first signal of a voltage increasing with a predetermined slope to a scan electrode and applies to a sustain electrode a voltage within a range which does not allow a substantial discharge between the sustain electrode and the scan electrode while the first signal is applied to the scan electrode. With such an operation, a discharge occurs between the scan electrode and an address electrode at a particular voltage in the middle of rising portion of the first signal, between the minimum and the maximum voltages of the first signal. In addition, the reset pulse generator 1042 applies voltages to the electrodes such that the potential difference between the address electrode and the scan electrode increases with a predetermined slope, thereby provoking a discharge between the address electrode and the scan electrode in the middle of an increase in the potential difference. Meanwhile, existence or nonexistence of a secondary discharge depends on the state of wall charges on the electrodes after the primary discharge between the address electrode and the scan electrode. If the state of the wall charges on the electrodes does not satisfy the addressing conditions, a secondary discharge occurs. The reset pulse generator 1042 can perform the same reset function as described referring to the other drawings. In this case, the reset pulse generator 1042 operating just as in the above embodiment can be easily implemented.

As described above, in a method and apparatus for driving a plasma display panel according to the present invention, during a reset period, a discharge is provoked between an address electrode and a scan electrode, but a discharge is prevented from occurring between a sustain electrode and the scan electrode, thereby suppressing an excessive reset discharge and allowing only a necessary discharge to occur. As a result, damage to the address electrode due to impacts of excessive ion particles can be prevented, a necessary time for a reset operation can be minimized, and wall charges can be formed on the electrodes such that an address operation can be smoothly performed.

What is claimed:

1. A method for driving a plasma display panel having a scan electrode, a sustain electrode and an address electrode, comprising steps of:

in a reset period, applying a first reset pulse and then applying a second reset pulse to the scan electrode, while applying a constant voltage to the sustain electrode and keeping the address electrode at ground voltage level, wherein the first reset pulse has a waveform of an increasing ramp pulse, wherein the second reset pulse has a waveform of a decreasing ramp pulse, and wherein the constant voltage is equal to or slightly higher than a sustain voltage.

2. The method of claim 1, wherein a slope of the first reset pulse is set to provoke a medium discharge.

3. The method of claim 2, wherein the first reset pulse waveform increases from a first starting voltage to a first ending voltage linearly, exponentially or logarithmically, and wherein the second reset pulse waveform decreases from a second starting voltage to a second ending voltage linearly, exponentially or logarithmically.

4. The method of claim 3, wherein the first ending voltage is sustained for a certain period, and wherein the second starting voltage is sustained for a certain period.

5. The method of claim 3, wherein the first reset pulse increases in a range that does not cause a discharge between the sustain electrode and the scan electrode.

6. The method of claim 5, wherein the first reset pulse increases with a slope that allows a discharge between the scan electrode and the address electrode while the first reset pulse voltage increases.

7. The method of claim 6, wherein the scan electrode and the address electrode are discharged in the middle of the slope where the first reset pulse increases.

8. The method of claim 6, wherein the first starting voltage is equal to or lower than a minimum discharge start voltage between the address electrode and the scan electrode, and wherein the first ending voltage is equal to or higher than a maximum discharge start voltage between the address electrode and the scan electrode.

9. The method of claim 3, wherein the second starting voltage is lower than the first ending voltage.

10. The method of claim 9, wherein the second starting voltage is so low that the second reset pulse does not cause discharge between the scan electrode and the sustain electrode.

11. The method of claim 10, wherein the second ending voltage is a lower-end voltage for a scan pulse applied to the scan electrode in an address period.

12. The method of claim 5, wherein a single frame of image is divided into a plurality of subfields, and wherein the slope and/or the first ending voltage of the first reset pulse for each subfield are different from each other.

13. The method of claim 5, wherein the slope of the first reset pulse is in a range of 10 V/μsec to 112 V/μsec.

14. An apparatus for driving a plasma display panel having a scan electrode driver and a sustain electrode, comprising:

a plasma display panel;

a frame memory that receives and stores digital data converted from an analog image signal;

a frame generator that divides the digital data stored in the frame memory;

a timing controller; and a scanning circuit that controls the scan electrode driver and the sustain electrode driver, comprising;

a reset pulse generator that generates a reset pulse having a waveform of a sloped ramp pulse;

an address pulse generator;

a sustain pulse generator;

an erasing pulse generator; and a synthesizing circuit that synthesizes pulse signals and applies such signals to the scan electrode and the sustain electrode, wherein the waveform of a sloped ramp pulse is set to provoke a medium discharge during a reset period.

15. The apparatus of claim 14, wherein the reset pulse generator generates a first reset pulse having a waveform of an increasing ramp pulse and a second reset pulse having a waveform of a decreasing ramp pulse.

16. The apparatus of claim 15, wherein the first reset pulse waveform increases from a first starting voltage to a first ending voltage linearly, exponentially or logarithmically, and wherein the second reset pulse waveform decreases from a second starting voltage to a second ending voltage linearly, exponentially or logarithmically.

17. The apparatus of claim 16, wherein the first starting voltage is equal to or lower than a minimum discharge start voltage between the address electrode and the scan electrode, and wherein the first ending voltage is equal to or higher than a maximum discharge start voltage between the address electrode and the scan electrode.

18. The apparatus of claim 17, wherein the first reset pulse is sloped to induce a discharge between a scan electrode and an address electrode in the middle of the slope where the first reset pulse increases.

19. A method for driving a plasma display panel having a scan electrode, a sustain electrode and an address electrode, comprising steps of:

during a reset period, applying to the scan electrode a first signal increasing with a predetermined slope; and applying to the sustain electrode a voltage within a range that does not allow a substantial discharge between the sustain electrode and the scan electrode, while the first signal is applied to the scan electrode, wherein a discharge occurs between the scan electrode and the address electrode at a certain voltage in the middle of the rising portion of the first signal.

20. The method of claim 19, further comprising steps of:

applying to the scan electrode a second signal starting from a voltage lower than a maximum voltage of the first signal and decreasing with a predetermined slope, after the first signal is applied to the scan electrode.

21. The method of claim 19, wherein the slope of the first signal depends on the reset period duration.

22. The method of claim 19, wherein at least two discharges occur discontinuously between the scan electrode and the address electrode.

23. A method for driving a plasma display panel having a scan electrode, a sustain electrode and an address electrode, comprising steps of:

during a reset period, applying to the scan electrode a first signal having at least two parts including a first part and a second part increasing with a predetermined slope; and applying to the sustain electrode a voltage within a range that does not allow a substantial discharge between the sustain electrode and the scan electrode, while the first signal is applied to the scan electrode, wherein a discharge occurs between the scan electrode and the address electrode at a certain voltage in the middle of the rising portion of the first signal.

24. The method of claim 23, wherein the first part of the first signal has a slope steeper than the second part of the first signal.

25. The method of claim 24, wherein the first part precedes the second part.

26. The method of claim 25, wherein a discharge between the scan electrode and the address electrode occurs after the first part.

27. A method for driving a plasma display panel having a scan electrode, a sustain electrode and an address electrode, comprising:

in a reset period, applying a first reset pulse and then applying a second reset pulse to the scan electrode, while applying a first constant voltage to the sustain electrode and applying a second constant voltage to the address electrode, wherein the first reset pulse has a waveform of an increasing ramp pulse, wherein the second reset pulse has a waveform of a decreasing ramp pulse, and wherein the first constant voltage is higher than the second constant voltage.

28. The method of claim 27, wherein the first constant voltage is equal to or slightly higher than a sustain voltage.

* * * * *